US008671953B2

(12) United States Patent
Martin

(10) Patent No.: US 8,671,953 B2
(45) Date of Patent: Mar. 18, 2014

(54) NAIL CLIPPING AND CATCHMENT APPARATUS

(75) Inventor: Miles Paul Martin, San Diego, CA (US)

(73) Assignee: The Power Straps, Inc., San Diego, CA (US)

( * ) Notice: Subject to any disclaimer, the term of this patent is extended or adjusted under 35 U.S.C. 154(b) by 1 day.

(21) Appl. No.: 13/237,821

(22) Filed: Sep. 20, 2011

(65) Prior Publication Data

US 2013/0068241 A1 Mar. 21, 2013

(51) Int. Cl.
*A45D 29/18* (2006.01)
*A45D 29/00* (2006.01)

(52) U.S. Cl.
USPC ..... 132/73.5; 132/285

(58) Field of Classification Search
USPC ..... 132/73, 73.5, 75, 75.3, 76.2, 76.5, 285, 132/319; 312/1; 30/28; 206/581, 823
See application file for complete search history.

(56) References Cited

U.S. PATENT DOCUMENTS

| | | | | | |
|---|---|---|---|---|---|
| 2,039,490 | A | * | 5/1936 | Mikelson | 312/1 |
| 3,060,819 | A | * | 10/1962 | Tohill | 396/591 |
| 3,267,830 | A | * | 8/1966 | Van Gaasbeek | 454/370 |
| 3,354,922 | A | * | 11/1967 | James | 312/1 |
| 5,017,197 | A | * | 5/1991 | McGuire et al. | 95/284 |
| 5,103,845 | A | * | 4/1992 | Matthews | 132/73 |
| 5,174,447 | A | * | 12/1992 | Fleming | 206/373 |
| 5,671,983 | A | * | 9/1997 | Miller et al. | 312/1 |
| 6,708,697 | B1 | * | 3/2004 | Ziff | 132/73 |

* cited by examiner

*Primary Examiner* — Robyn Doan
(74) *Attorney, Agent, or Firm* — Mintz Levin Cohn Ferris Glovsky and Popeo, P.C.

(57) ABSTRACT

A nail clipping and catchment apparatus is disclosed. The apparatus includes a flexible breathable backing layer having a shape, and a window layer having substantially the same shape as the backing, and being mated to an edge of the backing by an upper seam sufficient to create a pouch, the pouch for catching and containing nail clippings. The apparatus further includes a number of openings in the window layer, the plurality of openings including opposing hand openings on opposite sides of a bottom portion of the pouch near the edge and separated by a lower seam between the breathable backing layer and the window layer, the opposing hand openings each for receiving a nail-bearing extremity of a human. The apparatus further includes one or more pockets positioned on an outer surface of the pouch, the one or more pockets each having an access opening aligned toward the upper seam of the pouch.

18 Claims, 4 Drawing Sheets

NAIL CLIPPING AND CATCHMENT APPARATUS

BACKGROUND

Care of nails of a human extremity can be dirty and unhygienic. Further, the tools that a person uses can be scattered and misplaced. What is needed is a way to keep nail tools together in a manner that they are available in an environment where a person is tending to their nails, as well as a mechanism to make the nail-tending work clean and hygienic.

SUMMARY

This document describes a nail clipping and catchment apparatus.

In one aspect, a nail clipping and catchment apparatus includes a flexible breathable backing layer having a shape, and a window layer having substantially the same shape as the backing, and being mated to an edge of the backing by an upper seam sufficient to create a pouch, the pouch for catching and containing nail clippings. The apparatus further includes a number of openings in the window layer, the plurality of openings including opposing hand openings on opposite sides of a bottom portion of the pouch near the edge and separated by a lower seam between the breathable backing layer and the window layer, the opposing hand openings each for receiving a nail-bearing extremity of a human. The apparatus further includes one or more pockets positioned on an outer surface of the pouch, the one or more pockets each having an access opening aligned toward the upper seam of the pouch.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
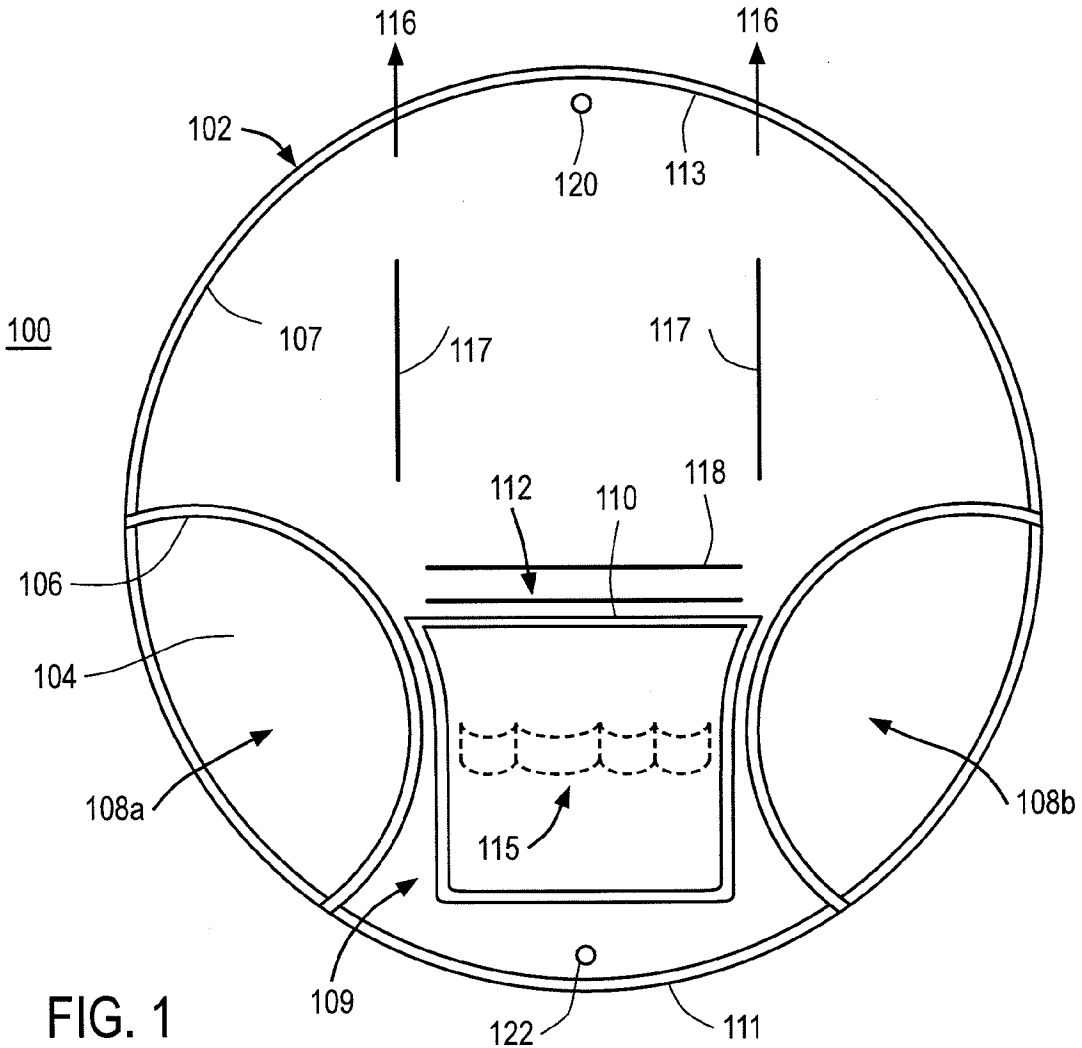
FIG. 1 illustrates a nail clipping and catchment apparatus, having a substantially round shape.

FIG. 1 illustrates a nail clipping and catchment apparatus 100 according to some implementations. The nail clipping and catchment apparatus 100 includes a pouch 102 formed to catch and contain nail clippings. The pouch 102 is formed of two flexible layers of material that are mated together at most of their respective seams. The flexible layers include a breathable backing layer 104 and a window layer 106 mated together at some or most of their seams 107. In some preferred implementations, the breathable backing layer 104 is made of a woven or mesh-type material, and can be made of nylon, cotton, threaded metal, plastic or other resilient material that can be formed into a flexible breathable layer of material. The window layer 106 can be made of polyurethane, clear plastic, or any other washable, translucent material. In some preferred exemplary implementations, the breathable backing layer 104 and window layer 106 are mated together by being sewn together by stitching, by thermal bonding, by glue or any other technique or composition to mate the layers together at their seams.

The nail clipping and catchment apparatus 100 further includes a number of openings, preferably for receiving into the inner containment area of the pouch one or more nail-bearing extremities of a human, such as hands or feet. The openings include opposing hand openings 108*a* and 108*b*, positioned and formed on opposite sides of a bottom portion 109 of the pouch 102 near an edge of the pouch, and separated by a lower seam 111 between the breathable backing layer 104 and the window layer 106. The openings can also include one or more slits 117 that enable a user to access the pouch 102, such as when a foot is inserted into one of the opposing hand openings 108*a* or 108*b*.

The opposing hand openings 108*a* and 108*b* are large enough to receive a nail-bearing extremity of a human, yet still allow for the upper half of the pouch 102 to have ample nail containment volume or area. The nail clipping and catchment apparatus 100 further includes at least one pocket 110 positioned on an outer surface of the pouch 102, preferably on an outer surface of the window layer 106 between the opposing hand openings 108*a* and 108*b*. The at least one pocket 110 includes an access opening 112 aligned toward an upper seam 113 of the pouch 102. The at least one pocket 110 can include a number of bands 115, each band 115 for receiving one tool of a plurality of manicure tools. The manicure tools can include, without limitation, one or more of the following: nail clippers, nail file, scissors, nail cleaner, etc.

Figure 2:
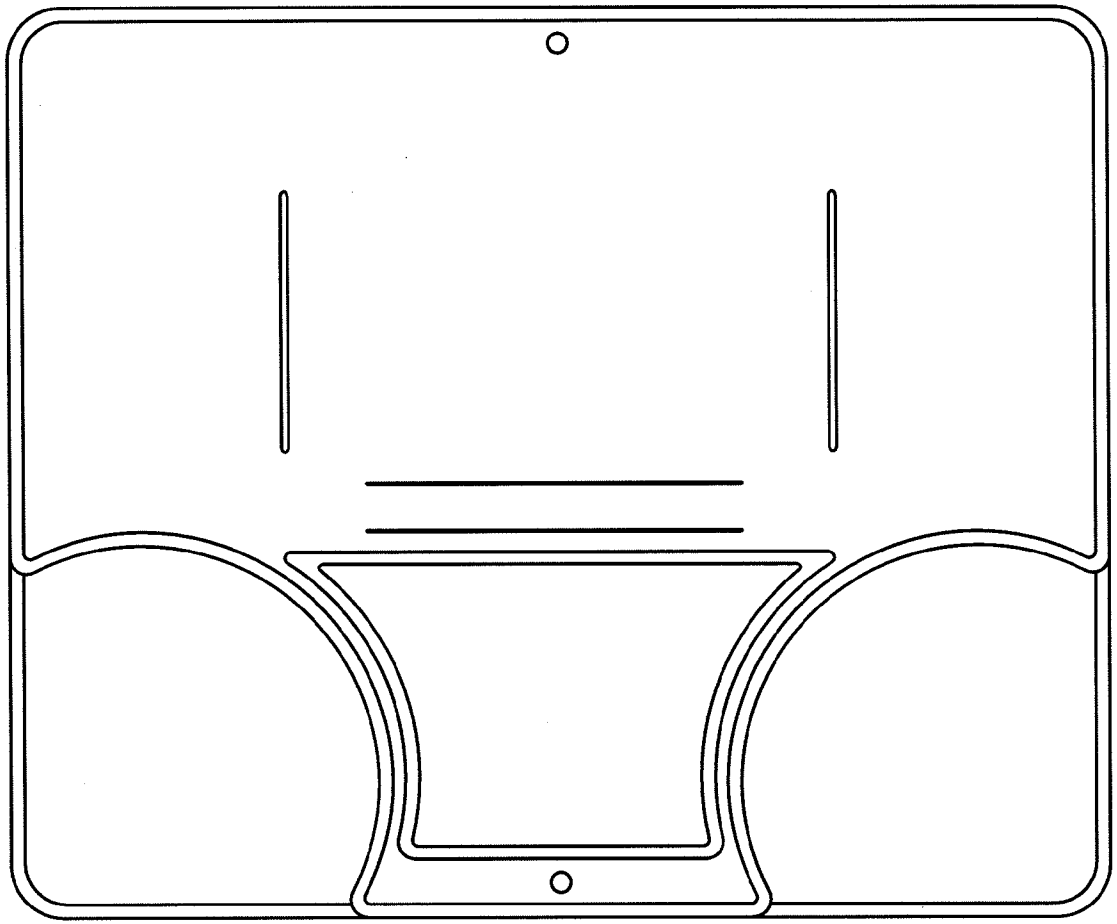
FIG. 2 illustrates an implementation of a nail clipping and catchment apparatus 200, having a substantially squared or rectangular shape.
Figure 3:
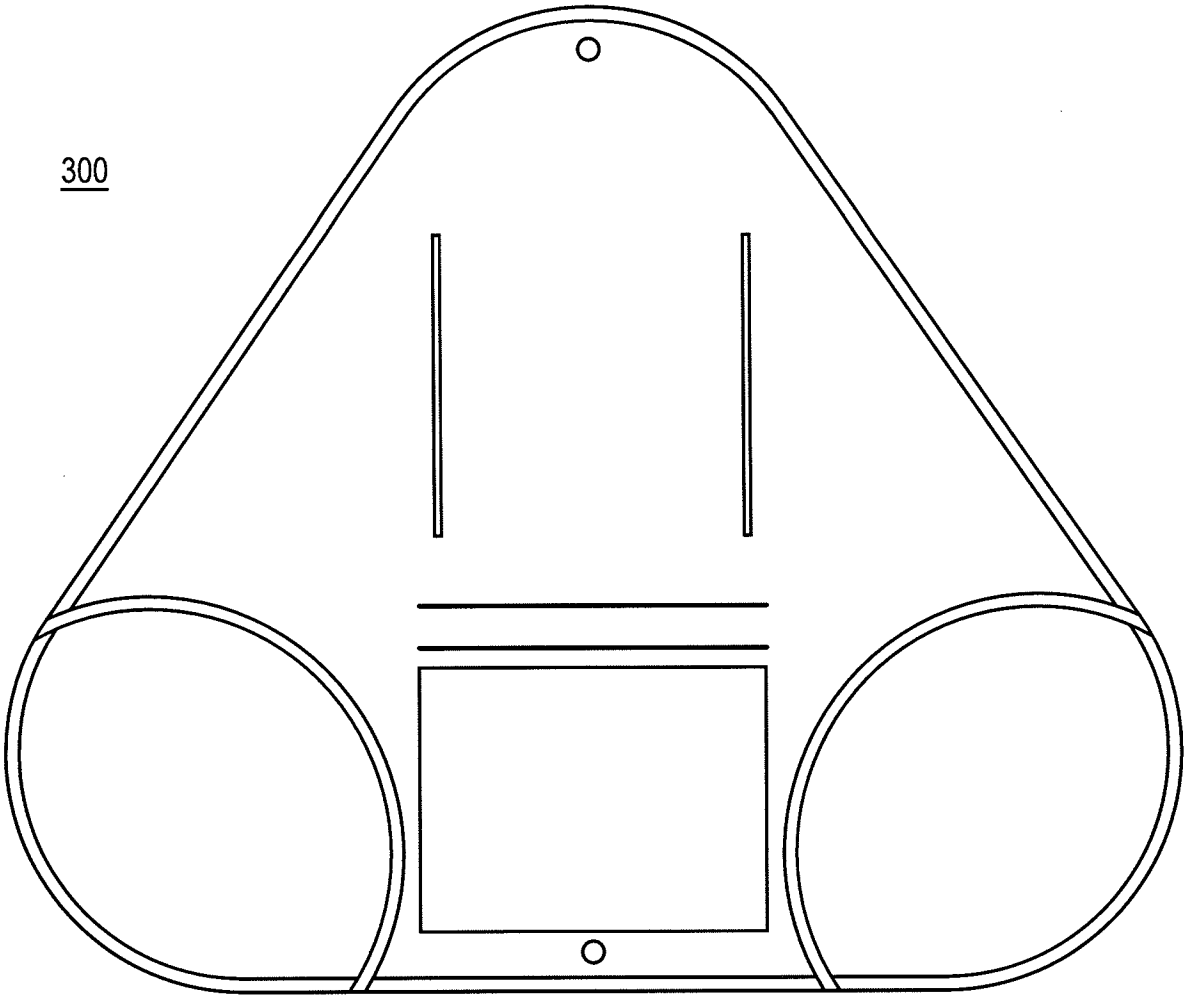
FIG. 3 illustrates an implementation of a nail clipping and catchment apparatus 200, having a substantially triangular shape.

The pouch 102 is foldable along opposing vertical axes 116 between the one or more pockets 110 and the opposing hand openings 108*a* and 108*b*. Thereafter, the pouch 102 can be folded in half along a horizontal axis 118. The nail clipping and catchment apparatus 100 further includes a securing mechanism, including an upper securing mechanism 120 attached to the window layer near the upper seam 113, and a lower securing mechanism 122 attached to the window layer near the lower seam 111. The upper and lower securing mechanisms 120 and 122 are releasably engagable with each other when the pouch is folded in half along a horizontal axis 118, preferably after the opposite sides of the pouch 102 are folded in first. The securing mechanism can be a snap, a button, a hook-and-loop attachment, a tie, a set of magnets, or any other type of securing mechanism. When the pouch 102 is folded in on its sides vertically, and then over along the horizontal axis, any nails within the pouch are secured therein, and FIG. 2 illustrates an implementation of a nail clipping and catchment apparatus 200, having substantially a squared or rectangular shape. FIG. 3 illustrates an implementation of a nail clipping and catchment apparatus 200, having substantially a triangular shape.

Figure 4:
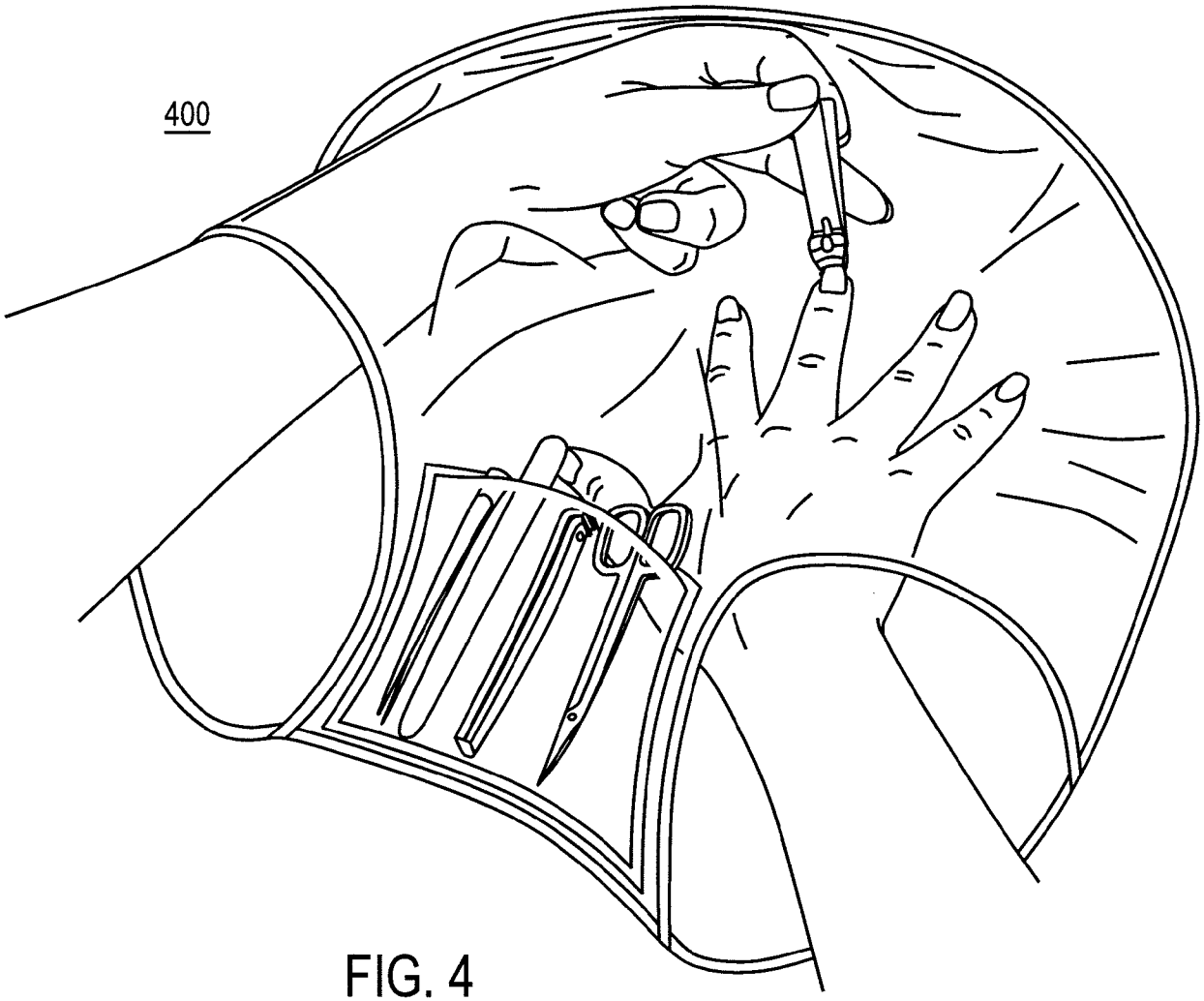
FIG. 4 shown a nail clipping and catchment apparatus in use.

FIG. 4 illustrates the use and operation of a nail clipping and catchment apparatus 400. A user unfolds and lays out the pouch as shown, and grasps one of the plurality of nail tools from its pocket. Then, the user can insert one nail-bearing extremity into one of the openings, while inserting a hand into the other opening to maneuver to and operate on a nail of the extremity. Any nail that is clipped is caught in and contained by the nail clipping and catchment apparatus 400, which can later be disposed of by shaking the apparatus 400 over a trash can or suitable receptacle.

Although a few embodiments have been described in detail above, other modifications are possible. Other embodiments may be within the scope of the following claims.

The invention claimed is:

1. A nail clipping and catchment apparatus comprising:

a flexible breathable backing layer having a shape;

a window layer having substantially the same shape as the backing, and being mated to an edge of the backing by an upper seam sufficient to create a pouch, the pouch for catching and containing nail clippings;

a plurality of openings in the window layer, the plurality of openings including opposing hand openings on opposite sides of a bottom portion of the pouch near the edge and separated by a lower seam between the breathable backing layer and the window layer, the opposing hand openings each for receiving a nail-bearing extremity of a human; and one or more pockets positioned on an outer surface of the pouch, the one or more pockets each having an access opening aligned toward the upper seam of the pouch, wherein the plurality of openings further comprise at least one slit in the window layer in a top portion of the pouch.

2. The apparatus of claim 1, wherein the shape has a width of between 8 and 14 inches.

3. The apparatus of claim 1, wherein the flexible breathable backing layer includes a mesh material.

4. The apparatus of claim 1, wherein the window layer is formed of polyurethane.

5. The apparatus of claim 1, wherein the one or more pockets are positioned on an outer surface of the window layer between the opposing hand openings.

6. The apparatus of claim 1, wherein the one or more pockets includes a plurality of bands, each band for receiving one tool of a plurality of manicure tools.

7. A nail clipping and catchment apparatus comprising:

a flexible breathable backing layer having a shape;

a window layer having substantially the same shape as the backing, and being mated to an edge of the backing by an upper seam sufficient to create a pouch, the pouch for catching and containing nail clippings;

a plurality of openings in the window layer, the plurality of openings including opposing hand openings on opposite sides of a bottom portion of the pouch near the edge and separated by a lower seam between the breathable backing layer and the window layer, the opposing hand openings each for receiving a nail-bearing extremity of a human;

one or more pockets positioned on an outer surface of the pouch, the one or more pockets each having an access opening aligned toward the upper seam of the pouch; and a plurality of nail tools that are sized to fit into the one or more pockets.

8. The apparatus of claim 7, further comprising a securing mechanism, the securing mechanism including an upper securing mechanism attached to the window layer near the upper seam, and a lower securing mechanism attached to the window layer near the lower seam, the upper and lower securing mechanisms releasably engaging with each other when the pouch is folded in half along a horizontal axis.

9. The apparatus of claim 8, wherein the pouch is foldable along opposing vertical axes between the one or more pockets and the opposing hand openings, prior to the pouch being folded in half along the horizontal axis and the upper and lower securing mechanisms releasably engaging with each other.

10. A nail clipping and catchment apparatus comprising:

a pouch formed of a flexible breathable backing layer and a window layer mated together at their respective seams, the pouch being formed to catch and contain nail clippings;

a plurality of openings in the window layer of the pouch, the plurality of openings including opposing hand openings on opposite sides of a bottom portion of the pouch near an edge of the pouch and separated by a lower seam between the breathable backing layer and the window layer, the opposing hand openings each formed to receive a nail-bearing extremity of a human; and one or more pockets positioned on an outer surface of the pouch, the one or more pockets each having an access opening aligned toward an upper seam of the pouch, wherein the plurality of openings further comprise at least one slit in the window layer in a top portion of the pouch.

11. The apparatus of claim 10, wherein the pouch has a width of between 8 and 14 inches.

12. The apparatus of claim 10, wherein the flexible breathable backing layer includes a mesh material.

13. The apparatus of claim 10, wherein the window layer is formed of polyurethane.

14. The apparatus of claim 10, wherein the at least one pocket is positioned on an outer surface of the window layer between the opposing hand openings.

15. The apparatus of claim 10, wherein the at least one pocket includes a plurality of bands, each band for receiving one tool of a plurality of manicure tools.

16. A nail clipping and catchment apparatus comprising:

a pouch formed of a flexible breathable backing layer and a window layer mated together at their respective seams, the pouch being formed to catch and contain nail clippings;

a plurality of openings in the window layer of the pouch, the plurality of openings including opposing hand openings on opposite sides of a bottom portion of the pouch near an edge of the pouch and separated by a lower seam between the breathable backing layer and the window layer, the opposing hand openings each formed to receive a nail-bearing extremity of a human;

at least one pocket positioned on an outer surface of the pouch, each of the at least one pocket having an access opening aligned toward an upper seam of the pouch; and a plurality of nail tools that are sized to fit into the one or more pockets.

17. The apparatus of claim 16, further comprising a securing mechanism, the securing mechanism including an upper securing mechanism attached to the window layer near the upper seam, and a lower securing mechanism attached to the window layer near the lower seam, the upper and lower securing mechanisms releasably engaging with each other when the pouch is folded in half along a horizontal axis.

18. The apparatus of claim 17, wherein the pouch is foldable along opposing vertical axes between the one or more pockets and the opposing hand openings, prior to the pouch being folded in half along the horizontal axis and the upper and lower securing mechanisms releasably engaging with each other.

* * * * *